US009702613B2

(12) United States Patent
Yoo et al.

(10) Patent No.: US 9,702,613 B2
(45) **Date of Patent: *Jul. 11, 2017**

(54) REFRIGERATOR

(71) Applicant: SAMSUNG ELECTRONICS CO., LTD., Suwon-si, Gyeonggi-do (KR)

(72) Inventors: Woo Yeol Yoo, Gwangju (KR); Hyun Sang Yoo, Gwangju (KR); Byoung Mok Kim, Kwangju (KR); Seong Woo Kim, Anyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/016,369

(22) Filed: Feb. 5, 2016

(65) Prior Publication Data

US 2016/0153700 A1 Jun. 2, 2016

Related U.S. Application Data

(63) Continuation of application No. 14/105,715, filed on Dec. 13, 2013, now Pat. No. 9,285,155.

(30) Foreign Application Priority Data

Feb. 23, 2013 (KR) ..... 10-2013-0019523

(51) Int. Cl.
*F25D 23/04* (2006.01)
*F25D 25/02* (2006.01)
(Continued)

(52) U.S. Cl.
CPC ..... *F25D 23/04* (2013.01); *E05D 15/04* (2013.01); *E05F 3/18* (2013.01); *F25D 23/00* (2013.01);
(Continued)

(58) Field of Classification Search
CPC ..... F25D 25/00; F25D 25/005; F25D 25/02; F25D 25/021; F25D 25/022;
(Continued)

(56) References Cited

U.S. PATENT DOCUMENTS 5,207,781 A 5/1993 Rock
5,961,193 A 10/1999 Hobbs
(Continued)

FOREIGN PATENT DOCUMENTS

CN 1483981 3/2004
CN 102128537 7/2011
(Continued)

OTHER PUBLICATIONS

EP1116846 Translated Description.pdf, 18 pages.*
(Continued)

*Primary Examiner* — Andrew Roersma
(74) *Attorney, Agent, or Firm* — Staas & Halsey LLP

(57) ABSTRACT

A refrigerator capable of varying the positions of a plurality of door guards provided at an opening of a refrigerating door, in which when an outer door configured to open and close the opening is closed in a state that a door guard is withdrawn, the door guard comes into contact with the outer door and thus automatically inserted, the refrigerator including a body, a storage compartment provided at an inside of the body so as to be open at a front surface thereof, and having a refrigerating compartment and a freezing compartment, an inner door formed with an opening at which a plurality of door guards are provided, and configured to open and close the refrigerating compartment, an outer door to open and close the opening provided at the inner door, a guide rail allowing at least one of the plurality of door guards to be inserted and withdrawn in a sliding manner, a slide unit connected to the at least one door guard so as to
(Continued)

be slid along the guide rail such that the at least one door guard is inserted and withdrawn, an elastic unit coupled to the slide unit to transmit a tensile force in a direction of the at least one door guard being inserted, and an automatic closing unit coupled to the at least one door guard, and configured to allow the elastic unit to transmit a tensile force to the at least one door guard when the outer door is closed and comes into the at least one door guard in a state in which the at least one door guard is withdrawn.

4 Claims, 12 Drawing Sheets

(51) Int. Cl.

| | |
|---|---|
| ***F25D 23/00*** | (2006.01) |
| ***F25D 23/02*** | (2006.01) |
| ***E05D 15/04*** | (2006.01) |
| ***E05F 3/18*** | (2006.01) |
| ***A47B 88/467*** | (2017.01) |

(52) U.S. Cl.
CPC ..... *F25D 23/02* (2013.01); *F25D 23/021* (2013.01); *F25D 23/028* (2013.01); *F25D 25/025* (2013.01); *A47B 88/467* (2017.01); *F25D 23/025* (2013.01)

(58) Field of Classification Search
CPC ... F25D 25/024; F25D 25/025; A47B 88/047; A47B 88/0477; A47B 88/0481; A47B 2088/047; A47B 2088/0474
USPC ..... 312/402, 404, 405, 405.1, 321.5, 311, 312/334.44, 334.46, 334.47, 215, 222, 312/333, 319.1
See application file for complete search history.

(56) References Cited

U.S. PATENT DOCUMENTS

| | | | |
|---|---|---|---|
| 6,340,078 | B1 | 1/2002 | Scheible |
| 7,249,813 | B2 | 7/2007 | Gasser |
| 7,686,406 | B2 | 3/2010 | Lee |
| 7,810,890 | B2 | 10/2010 | Klein et al. |
| 8,322,805 | B2 | 12/2012 | Kwon et al. |
| 2004/0056573 | A1 | 3/2004 | Chae |
| 2007/0126324 | A1 | 6/2007 | Lee |
| 2008/0047295 | A1 | 2/2008 | Kim et al. |
| 2008/0191589 | A1 | 8/2008 | Dorner et al. |
| 2008/0265734 | A1 | 10/2008 | Hecht et al. |
| 2010/0066225 | A1 | 3/2010 | Chang |
| 2011/0048059 | A1 | 3/2011 | Song et al. |
| 2011/0095670 | A1 | 4/2011 | Cho et al. |
| 2011/0210653 | A1 | 9/2011 | Salice |
| 2012/0286638 | A1 | 11/2012 | Lee et al. |
| 2012/0288221 | A1 | 11/2012 | Jahrling et al. |
| 2012/0293056 | A1 | 11/2012 | Kim |
| 2013/0033163 | A1* | 2/2013 | Kang ..... F25D 23/04 312/405.1 |

FOREIGN PATENT DOCUMENTS

| | | |
|---|---|---|
| EP | 1 116 846 | 10/2004 |
| JP | 2011-69612 | 4/2011 |
| KR | 10-2002-0080938 | 10/2002 |
| KR | 10-2012-0019630 | 3/2012 |
| KR | 10-2012-0063316 | 5/2012 |
| RU | 2 350 859 | 3/2009 |
| WO | WO 2011/081279 A1 | 7/2011 |
| WO | WO 2013/022198 | 2/2013 |

OTHER PUBLICATIONS

Notice of Acceptance mailed Apr. 6, 2016 in Australian Patent Application No. 2014219633.
U.S. Office Action mailed Oct. 28, 2014 in related U.S. Appl. No. 14/105,715.
U.S. Office Action mailed Feb. 20, 2016 in related U.S. Appl. No. 14/105,715.
U.S. Interview Summary mailed Apr. 22, 2015 in related U.S. Appl. No. 14/105,715.
U.S. Advisory Action mailed Apr. 29, 2015 in related U.S. Appl. No. 14/105,715.
U.S. Office Action mailed Jun. 8, 2015 in related U.S. Appl. No. 14/105,715.
U.S. Notice of Allowance mailed Nov. 10, 2015 in related U.S. Appl. No. 14/105,715.
U.S. Corrected Notice of Allowability mailed Nov. 23, 2015 in related U.S. Appl. No. 14/105,715.
Chinese Office Action issued on Sep. 20, 2016 in corresponding Chinese Patent Application No. 201480010155.1.
Decision on Grant issued on Jul. 12, 2016 in corresponding European Patent Application No. 13 196 956.0.
Russian Notice of Allowance issued on Sep. 7, 2016 in corresponding Russian Patent Application No. 2015135586.

* cited by examiner

REFRIGERATOR

CROSS-REFERENCE TO RELATED APPLICATIONS

This application is a continuation of U.S. application Ser. No. 14/105,715 filed Dec. 13, 2013, which claims the benefit of Korean Patent Application No. 10-2013-0019523, filed on Feb. 23, 2013 in the Korean Intellectual Property Office, the disclosures of which are incorporated herein by reference.

BACKGROUND

1. Field

Embodiments of the present disclosure relate to a refrigerator.

2. Description of the Related Art

In general, a refrigerator represents an apparatus having a storage compartment, and a cool air supply device to supply the storage compartment with cool air so as to keep foods fresh.

The temperature of the storage compartment is maintained in a predetermined range of temperature required to keep food fresh.

The storage compartment is provided so as to be open at a front surface thereof, and the open front surface may be closed by a door to maintain the temperature of the storage compartment at a sufficiently cool temperature.

The storage compartment is divided into a left side and a right side by a partition wall, and the storage compartments divided into the left and right side are open and closed by double side doors that are rotatably hinged.

A refrigerating compartment door to open and close a refrigerating compartment of the storage compartments is formed with an opening, and the opening of the refrigerating compartment door is open and closed by an outer door.

A plurality of door guards provided at the opening are disposed at fixed positions so as not to be moved, whereby the efficiency in accommodating food items and the usability are degraded.

SUMMARY

Therefore, it is an aspect of the present disclosure to provide a refrigerator capable of varying the positions of a plurality of door guards provided at an opening of a refrigerating compartment door.

In addition, it is another aspect of the present disclosure to provide a refrigerator, in which, when an outer door configured to open and close the opening is closed in a state that a door guard is withdrawn, the door guard comes into contact with the outer door and thus is automatically inserted.

Additional aspects of the disclosure will be set forth in part in the description which follows and, in part, will be obvious from the description, or may be learned by practice of the disclosure.

In accordance with an embodiment of the present disclosure, a refrigerator includes a body, a storage compartment, an inner door, an outer door, a guide rail, a slide unit, a slid unit, an elastic unit, and an automatic closing unit. The storage compartment may be provided at an inside of the body so as to be open at a front surface thereof, and have a refrigerating compartment and a freezing compartment. The inner door may be formed with an opening at which a plurality of door guards are provided, and may be configured to open and close the refrigerating compartment. The outer door may be configured to open and close the opening provided at the inner door. The guide rail may allow at least one of the plurality of door guards to be inserted and withdrawn in a sliding manner. The slide unit may be connected to the at least one door guard so as to be slid along the guide rail such that the at least one door guard is inserted and withdrawn. The elastic unit may be coupled to the slide unit to transmit a tensile force in a direction of the at least one door guard being inserted. The automatic closing unit may be coupled to the at least one door guard, and configured to allow the elastic unit to transmit a tensile force to the at least one door guard when the outer door is closed and comes into the at least one door guard in a state in which the at least one door guard is withdrawn.

The guide rail may include a support part supported by both side walls of the opening, and a rail part extending from the support part to guide the at least one door guard.

The rail part may include a first rail part provided adjacent to a left side wall of both side walls, and a second rail part provided adjacent to a right side wall of both side walls, and a locking part protruding upward may be provided on the second rail part.

A case may be coupled to a lower portion of the at least one door guard, and the slide unit may be coupled to the case to move along the rail part such that the at least one door guard is inserted and withdrawn.

The slide unit may include a first sliding part coupled to a lower portion of the case to correspond to the first rail part, a second sliding part coupled to a lower portion of the case to correspond to the second rail part, first slide rails coupled to the first rail part and the second rail part, respectively, and second slid rails coupled to lower portions of the first sliding part and the second sliding part, respectively, so as to be slid along the first slide rails.

The elastic unit may include an elastic member having one end fixed to the second sliding part to transmit the tensile force to the at least one door guard, a connection member having a coupling part, to which other end of the elastic member is coupled, and configured to move back and force so as to allow the elastic member to generate the tensile force, and a rotator rotatably coupled to a first rotation hole formed through the connection member.

The rotator may include a first rotating shaft rotatably coupled to the first rotation hole, a hook part locked with and released from the locking part provided on the second rail part, and a protrusion part protruding from the rotator downward.

The second sliding part may include a fixing part to which the one end of the elastic member is fixed, an accommodation part in which the elastic unit is accommodated, and a guide rail to guide the protrusion part.

The guide rail may include a straight line path along which the protrusion part performs a straight linear motion in a front and back direction, and a locking groove provided at an end portion of the straight line path so as to allow the protrusion part, while performing a straight linear motion on the straight line path, to be locked with the locking groove as the rotator rotates on the first rotating shaft.

The rotator may move in the same direction as the at least one door guard together with the at least one door guard when the at least one door guard is withdrawn, such that the hook part is locked with the locking part, and if the at least door guard is withdrawn in a state in which the hook part is locked with the locking part, the protrusion part may move in an opposite direction to the at least one door guard along the straight line path, such that the tensile force is generated from the elastic member coupled to the connection member.

The rotator, if the withdrawing of the at least one door guard is completed, may rotate on the first rotating shaft clockwise as the protrusion part having moved along the straight line path moves along the locking groove, and according to the rotation of the rotator, the hook part may be released from the locking part and the protrusion part is locked with the locking groove, so that the tensile force of the elastic member is maintained.

The automatic closing unit may include a first lever rotatably coupled to the case to come into contact with the outer door, a second lever rotatably coupled to the case to come into contact with the rotator, and a link connecting the first lever to the second lever.

The case may include a second rotating shaft, a third rotating shaft, and an opening formed adjacent to the second rotating shaft, and the first lever may be formed with a second rotation hole rotatably coupled to the second rotating shaft, and the second lever may be formed with a third rotation hole rotatably coupled to the third rotating shaft.

If the at least one door guard is withdrawn, the rotator may rotate clockwise to allow the second lever to rotate on the third rotating shaft clockwise, and as the second lever rotates clockwise, the first lever connected to the second lever through the link may rotate on the second rotating counterclockwise such that a part of the first lever protrudes outside the case through the opening of the case.

If the outer door is closed in a state in which the at least one door guard is withdrawn, the first lever protruding outside the case may rotate on the second rotating shaft clockwise by the outer door, and as the first lever rotates clockwise, the second lever connected to the first lever through the link, while rotating on the third rotating shaft counterclockwise, pushes the rotator to rotate on the first rotating shaft counterclockwise, so that the protrusion part is released from the locking groove and the at least one door guard is inserted by the tensile force of the elastic member.

In accordance with another aspect of the present disclosure, a refrigerator includes a body, a storage compartment, a door, a guide rail, a slide unit, an elastic unit, and an automatic closing unit. The storage compartment may be provided at an inside of the body so as to be open at a front surface thereof, and provided at an inside thereof with a plurality of storage containers. The door may be configured to open and close the storage compartment. The guide rail may allow at least one of the plurality of storage containers to be inserted and withdrawn in a sliding manner. The slide unit may be coupled to the at least one storage container so as to be slid along the guide rail such that the at least one storage container is inserted and withdrawn. The elastic unit may be coupled to the slide unit to transmit a tensile force in a direction of the at least one storage container being inserted. The automatic closing unit may be coupled to the at least one storage container, and allow the elastic unit to transmit the tensile force to the at least one storage container if the door is closed and the automatic closing unit comes into contact with the door in a state in which the at least storage container is withdrawn.

The refrigerator may further include a guide rail allowing at least one of the plurality of storage containers to be inserted and withdrawn in a sliding manner, and a slide unit coupled to the at least one storage container so as to be slid along the guide rail such that the at least one storage container is inserted and withdrawn.

In accordance with another aspect of the present disclosure, a sliding device allowing a plurality of door guards provided at an opening that is provided at an inner door, which is configured to open and close a storage compartment, and is open and closed by an outer door, to be inserted and withdrawn in a sliding manner includes a guide rail, a case, a slide unit, an elastic unit, and an automatic closing unit. The guide rail may be supported by both side walls of the opening so as to allow at least one of the plurality of door guards to be inserted and withdrawn in a sliding manner. The case may be coupled to a lower portion of the at least one door guard. The slide unit may be coupled to the case so as to be slid along the guide rail such that the at least one door guard is inserted and withdrawn. The elastic unit may be coupled to the slide unit to transmit a tensile force in a direction of the at least one door guard being inserted. The automatic closing unit may be coupled to the case, and allow the elastic unit to transmit the tensile force to the at least one door guard if the outer door is closed and the automatic closing unit may come into contact with the outer door in a state in which the at least one door guard is withdrawn, so that the at least one door guard is closed.

The guide rail may include a support part supported by both side walls of the opening, and a rail part extending from the support part toward inside the storage compartment to guide the at least one door guard.

The rail part may include a first rail part provided adjacent to a left side wall of both side walls, and a second rail part provided adjacent to a right side wall of both side walls, and a locking part protruding upward may be provided at the second rail part.

The elastic unit may include an elastic member having one end fixed to the sliding unit to transmit the tensile force to the at least one door guard, a connection member having a coupling part, to which other end of the elastic member is coupled, and configured to move back and force so as to allow the elastic member to generate the tensile, and a rotator rotatably coupled to a first rotation hole formed through the connection member.

The rotator may include a first rotating shaft rotatably coupled to the first rotation hole, a hook part locked with and released from the locking part provided on the second rail part, and a protrusion part protruding from the rotator downward.

The slide unit may include a second sliding part coupled to the case to correspond to the second rail part, and the second sliding part may include a fixing part to which the one end of the elastic member is fixed, an accommodation part in which the elastic unit is accommodated, and a guide rail to guide the protrusion part.

The guide rail may include a straight line path along which the protrusion part performs a straight linear motion in a front and back direction, and a locking groove provided at an end portion of the straight line path so as to allow the protrusion part, while performing a straight linear motion on the straight line path, to be locked with the locking groove as the rotator rotates on the first rotating shaft.

The automatic closing unit may include a first lever rotatably coupled to the case to come into contact with the outer door, a second lever rotatably coupled to the case to come into contact with the rotator, and a link connecting the first lever to the second lever.

The case may include a second rotating shaft, a third rotating shaft, and an opening formed adjacent to the second rotating shaft, and the first lever may be formed with a second rotation hole rotatably coupled to the second rotating shaft, and the second lever may be formed with a third rotation hole rotatably coupled to the third rotating shaft.

In accordance with another aspect of the present disclosure, a sliding device configured to allow a storage container, which is provided inside a storage compartment, to be inserted and withdraw in a sliding manner includes a case, a guide rail, a sliding unit, and an automatic closing unit. The case may be coupled to a lower portion of the storage container. The guide rail may allow the storage container to be inserted and withdrawn in a sliding manner. The sliding unit may be coupled to the case so as to be slide along the guide rail. The elastic unit may be coupled to the slide unit so as to transmit a tensile force in a direction of the storage container being inserted. The automatic closing unit may be coupled to the case and configured to allow the elastic unit to transmit a tensile force to the storage container if a door is closed and the automatic closing unit comes into the door in a state in which the storage container is withdrawn, so that the storage container is closed.

As is apparent from the above, the efficiency in accommodating stuff and the usability are maximized, the door guard is prevented from being broken, and the stuff accommodated in the door guard is safely protected.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
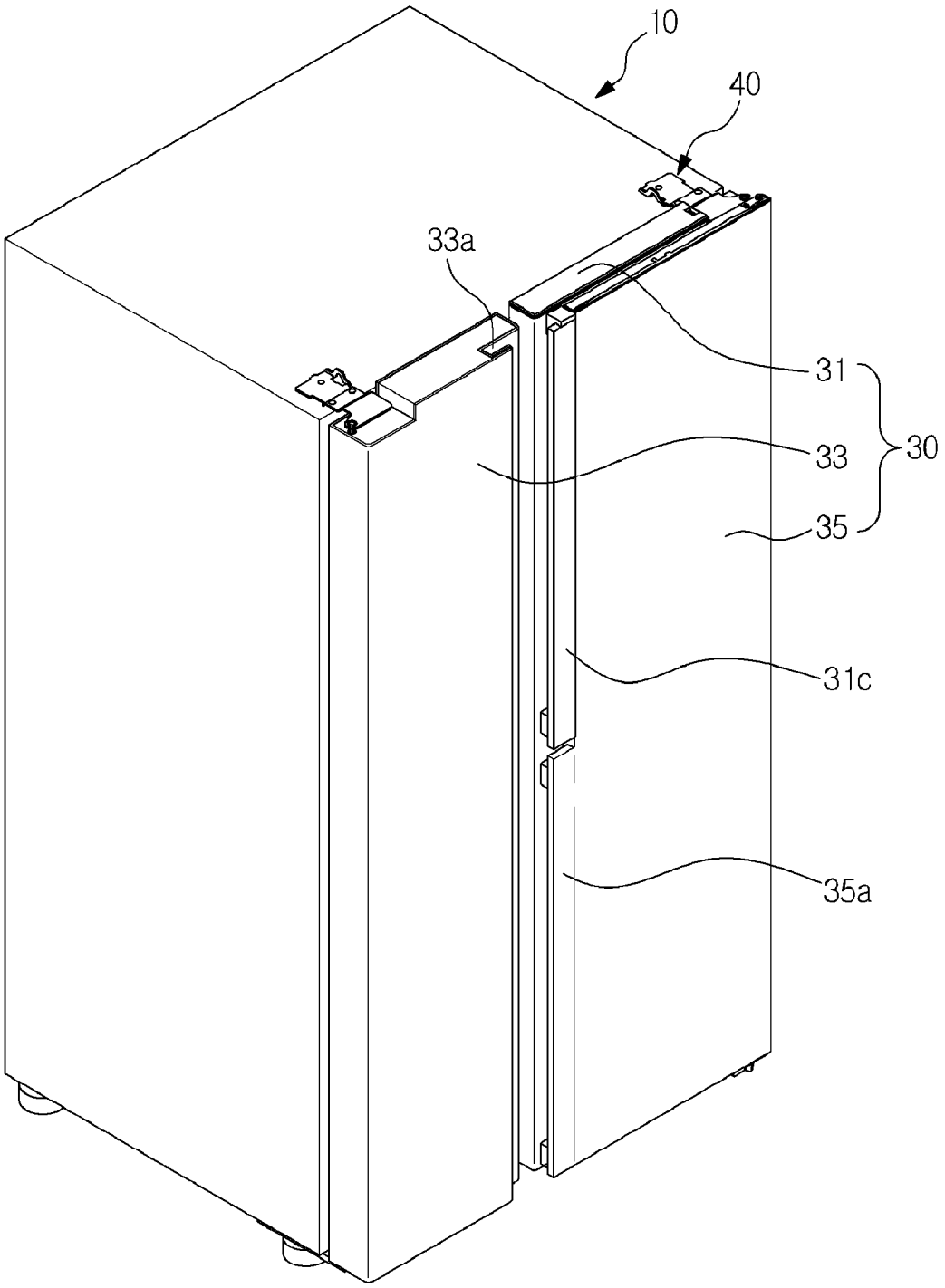
FIG. 1 is a perspective view illustrating a refrigerator in accordance with an embodiment of the present disclosure.
Figure 2:
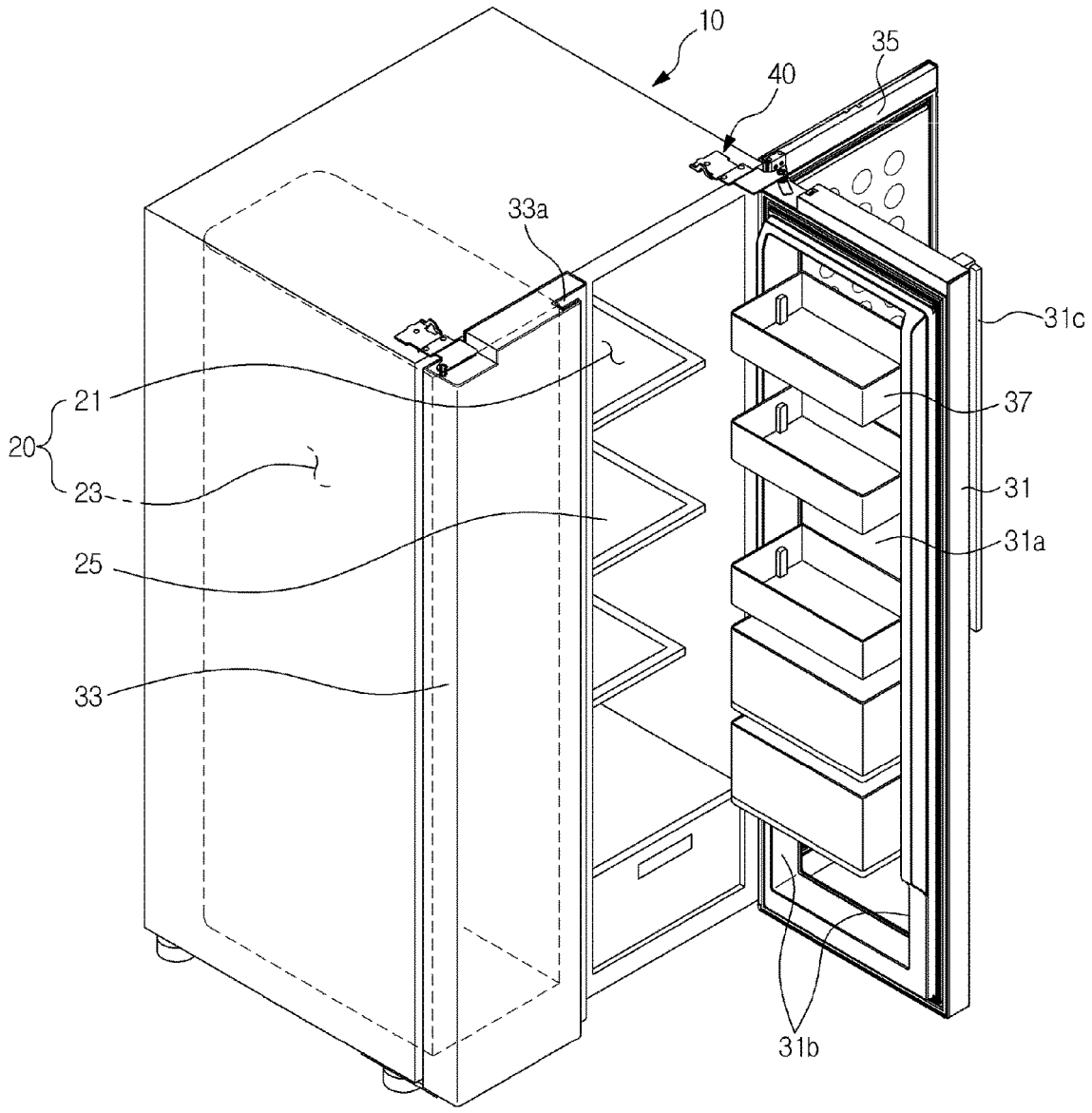
FIG. 2 is a perspective view illustrating an opening state of a refrigerating compartment door and an outer door of the refrigerator in accordance with an embodiment of the present disclosure.
Figure 3:
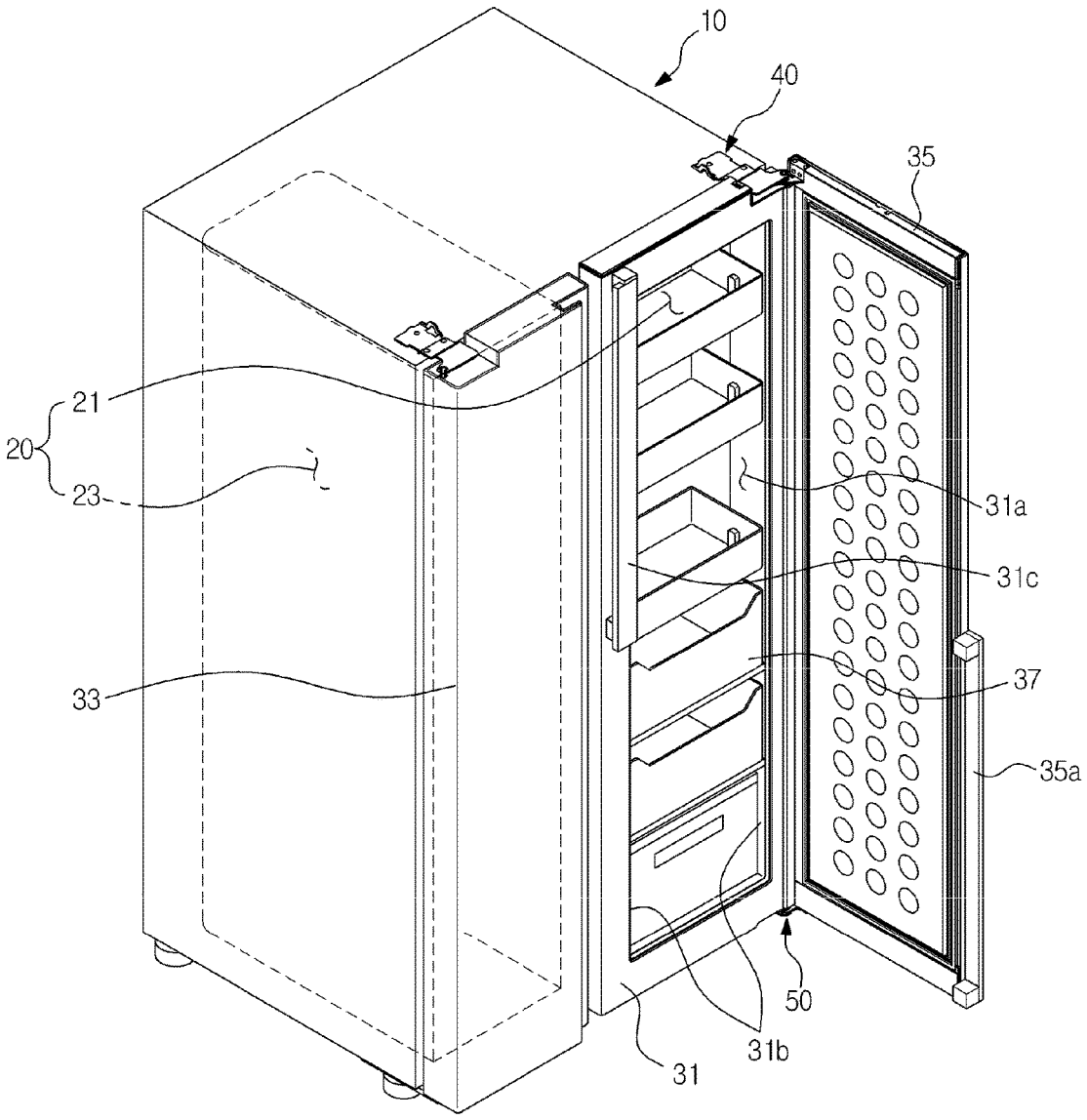
FIG. 3 is a perspective view illustrating an open state of an outer door of the refrigerator in accordance with an embodiment of the present disclosure.
Figure 4:
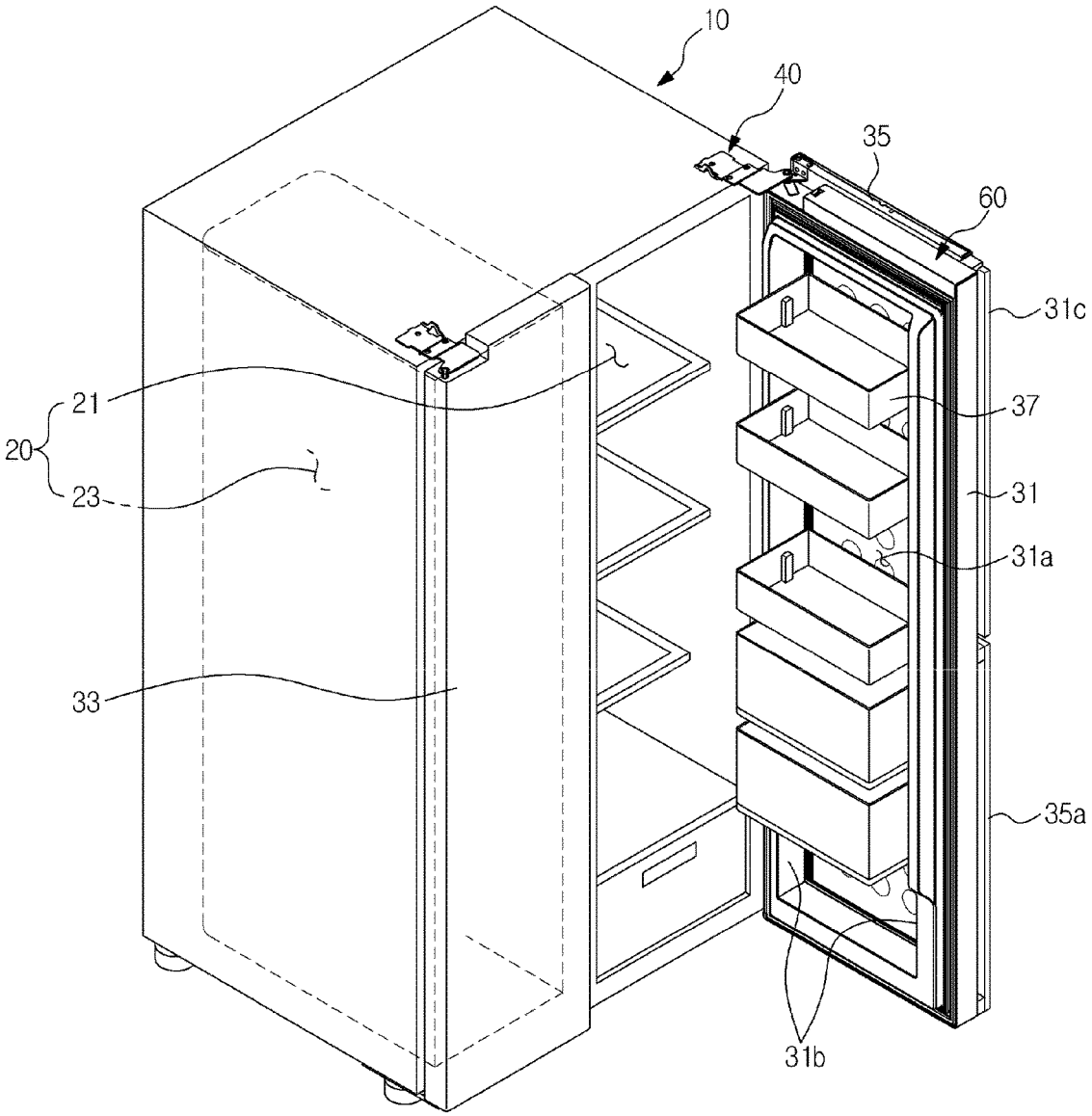
FIG. 4 is a perspective view illustrating an open state of a refrigerating compartment door of the refrigerator in accordance with an embodiment of the present disclosure.

Reference will now be made in detail to the embodiments of the present disclosure, examples of which are illustrated in the accompanying drawings, wherein like reference numerals refer to like elements throughout.

Referring to FIGS. 1 through 6, the refrigerator may include, for example, a body 10, a storage compartment 20 provided inside the body 10 so as to be open at a front surface thereof, a door 30 including a refrigerating compartment door 31 having an opening 31*a* and configured to open and close the storage compartment 20, and an outer door 35 to open and close the opening 31*a* provided at the refrigerating compartment door 31, an upper hinge 40 and a lower hinge 50 allowing the door 30 to be rotatably coupled to the body 10, and a sliding device 100 allowing a plurality of door guards 37 provided at the opening 31*a* of the refrigerating compartment door 31, to be inserted and withdrawn in a sliding manner. In an embodiment, the plurality of door guards 37 may be alternatively embodied as a plurality of storage containers or a plurality of door bins.

The body 10 includes an inner case (not shown) forming the storage compartment 20 and an outer case (not shown) forming the external appearance, and includes a cool air supply device (not shown) to supply the storage compartment 20 with cool air.

The cool air supply device includes a compressor, a condenser, an expansion valve, an evaporator, a blower fan, and a cool air duct, and heat insulation material (not shown), which is blown into a space between the inner case and the outer case to prevent cool air of the storage compartment 20 from leaking.

The body 10 is provided at a lower rear side thereof with a machine room (not shown) in which the compressor to compress refrigerant and the condenser to condense the compressed refrigerant are installed.

The storage compartment 20 is divided into left and right sides by a partition wall 11 to form a refrigerating compartment 21 at the right side of the body 10, and a freezing compartment 23 at the left side of the body 10.

A plurality of shelves 25 are provided at the refrigerating compartment 21 to divide the refrigerating compartment 21 into a plurality of spaces.

The refrigerating compartment 21 and the freezing compartment 23 are opened and closed by the refrigerating compartment door 31 and a freezing compartment door 33, respectively, which are pivotably coupled to the body 10, and the upper hinge 40 and the lower hinge 50 are coupled to an upper portion and a lower portion of the body 10, respectively, such that the refrigerating compartment door 31 and the freezing compartment door 33 are rotatably coupled to the body 10.

The refrigerating compartment door 31 is formed with the opening 31*a*, and the plurality of door guards 37 are provided at opening 31*a*.

The plurality of door guards 37 are provided so as to be alternatively inserted and withdrawn in a sliding manner by the sliding device 100, and the configuration of the sliding device 100 will be described later. For example, the plurality of door guards 37 may be pulled out or withdrawn away from the refrigerating compartment 21 and then may be inserted or pushed back into the refrigerating compartment 21 in a sliding manner by the sliding device 100, in order to more readily access food items stored using the door guards 37.

A refrigerating compartment door grip 31*c* and a freezing compartment door grip 33*a* are provided at the refrigerating compartment door 31 and the freezing compartment door 33, respectively. The grips 31*c* and 33*a* may be gripped by a user to open the refrigerating compartment door 31 and the freezing compartment door 33, respectively.

The opening 31*a* provided at the refrigerating compartment door 31 is open and closed by the outer door 35, and for the sake of convenience, the refrigerating compartment door 31 may be referred to as an inner door.

Separately from the refrigerating compartment door 31 and the freezing compartment door 33, the outer door 35 is also provided with an outer door grip 35*a* that may be gripped by a user to open the outer door 35.

Since the opening 31*a* provided at the inner door 31 has a size corresponding to the refrigerating compartment 21, the plurality of door guards 37 provided over the entire area of the refrigerating compartment 21, rather than a part of the refrigerating compartment 21, may be accessed or used by opening the outer door 35.

The upper hinge 40 and the lower hinge 50 are coupled at the upper portion and the lower portion of the body 10, respectively, such that each of the refrigerating compartment door 31 and the freezing compartment door 33 is rotatably coupled to the body 10, and each of the upper hinge 40 and the lower hinge 50 may be coupled to the outer door 35 and the refrigerating compartment door 31, which represents the inner door and on which the outer door 35 is provided.

Referring to FIGS. 5 to 8, the door guard 37 provided at the opening 31*a* in a plurality of units thereof are inserted and withdrawn in a sliding manner by the sliding device 100.

Although some of the plurality of door guards 37 are illustrated as fixed at both side walls 31*b* of the opening 31*a* and others of the plurality of door guards 37 are illustrated as being slidable by the sliding device 100 in FIGS. 5 to 8, all of the plurality of door guards 37 may be provided so as to be fixed to both side walls 31*b* or all of the plurality of door guards 37 may be provided so as to be slidable by the sliding device 100, or any combination of fixed or slidable door guards may be provided.

In addition, although the door guard 37 fixed to both side walls 31*b* of the opening 31*a* is illustrated to have a shape different from that of the door guard 37 slid by the sliding device 100, both of the door guards 37 may have the same shape, or the shapes of the door guards 37 may switched.

The sliding device 100 includes a guide rail 150 supported by both side walls 31*b* of the opening 31*a* of the inner door 31 to allow the door guard 37 to be inserted and withdrawn in a sliding manner, a case 110 coupled to a lower portion of the door guard 37, a slide unit 120 coupled to the case 110 so as to be slid along the guide rail 150, an elastic unit 130 to transmit a tensile force in a direction of the door guard 37 being inserted, and an automatic closing unit 140 configured to allow the elastic unit 130 to transmit a tensile force to the door guard 37 such that the door guard 37 is automatically inserted.

The guide rail 150 is supported by both side walls 31*b* of the opening 31*a* of the inner door 31 to guide the door guard 37 to be inserted and withdrawn in a sliding manner.

The guide rail 150 includes a support part 151 supported by both side walls 31*b* of the opening 31*a*, and a rail part 153 provided to extend from the support part 151 toward an interior of the refrigerating compartment 21 to guide the door guard 37.

Although not shown, in order to firmly fix the support part 151, a reinforcing member may be provided at both side walls 31*b* of the opening 31*a* such that the support part 151 is fixed to the reinforcing member.

The rail part 153 includes a first rail part 155 provided adjacent to a left side wall of side walls 31*b*, and a second rail part 157 provided adjacent to a right side wall of the side walls 31*b*.

The second rail part 157 is provided with a locking part 157*a* which protrudes upward and with which a hook part 135*b* of a rotator 135 of the elastic unit 130 may be locked and released from being locked. A more detailed description of the locking part 157*a* is provided later.

The case 110 is coupled to the lower portion of the door guard 37, and includes a second rotating shaft 111 and a third rotating shaft 113, which are coupled to a second rotation hole 141*a* and a third rotation hole 143*a*, respectively, which are formed at a first lever 141 and a second lever 143 of the automatic closing unit 140, respectively, and an opening 115 provided adjacent to the second rotating shaft 111.

The second rotation hole 141*a* formed through the first lever 141 is rotatably coupled to the second rotating shaft 111, and the third rotation hole 143*a* formed through the second lever 143 is rotatably coupled to the third rotating shaft 113.

The opening 115 is provided adjacent to the second rotating shaft 111 such that the first lever 141 protrudes to the outside when the door guard 37 is withdrawn or in a state of being partially withdrawn, and thus when the outer door 35 is closed, the first lever 141 makes contact with the outer door 35.

The slide unit 120 includes a first sliding part 121 coupled to a lower portion of the case 110 to correspond to the first rail part 155, a second sliding part 122 coupled to a lower portion of the case 110 to correspond to the second rail part 157, first slide rails 126 coupled to upper portions of the first rail part 155 and the second rail part 157, respectively, and second slide rails 127 coupled to lower portions of the first sliding part 121 and the second sliding part 122, respectively, so as to be slid along the first slide rail 126.

The first slide rails 126 are fixedly coupled to the upper portions of the first rail part 155 and the second rail part 157, respectively, and allow the second slide rails 127 fixedly coupled to the lower portions of the first sliding part 121 and the second sliding part 122, respectively, to be moved therealong such that the door guard 36 coupled to the case 110 is slidably moved in the front and back direction.

The second sliding part 122 includes a fixing part 123 to which one end of the elastic member 131 of the elastic unit 130 is fixed, an accommodation part 124 in which the elastic unit 131 is accommodated, and a guide rail 125 to guide a protrusion part 135*c* provided on the rotator 135 of the elastic unit 130.

The guide rail 125 includes a straight line path 125*a* along which the protrusion part 135*c* provided on the rotator 135 performs a straight linear motion in a front and back direction, and a locking groove 125*b* provided at an end portion of the straight line path 125*a* so as to allow the protrusion part 135*c*, while performing a straight linear motion on the straight line path 125*a*, to be locked with the locking groove 125*b* as the rotator 135 rotates on a first rotating shaft 135*a*.

The elastic member 131 having the one end fixed to the fixing part 123 generates a tensile force with the other end moving in a direction away from the fixing part 123. A more detailed description thereof will be provided later.

The elastic unit 130 includes the elastic member 131 having one end fixed to the second sliding part 122 to generate a tensile force, a connection member 133 to which the other end of the elastic member 131 is coupled, and the rotator 135 connected to the connection member 133 so as to allow the connection member 133 to move in a front and back direction and configured to move while being guided by the guide rail 125.

In an embodiment, the elastic member 131 has one end fixed to the fixing part 123 of the second sliding part 122 and has the other end coupled to the connection member 133. As the connection member 133 moves away from the fixing part 123, the elastic member 131 accumulates a tensile force, and the accumulated tensile force acts in an insertion direction of the door guard 37 by the automatic closing unit 140 that operates in contact with the outer door 35, so that the door guard 37 is automatically closed.

The connection member 133 includes a coupling part 133*a*, to which the other end of the elastic member 131 is coupled, and a first rotation hole 133*b* coupled to the rotator 135.

The rotator 135 includes the first rotating shaft 135*a* rotatably coupled to the first rotation hole 133*b* formed through the connection member 133, the hook part 135*b* locked with and released from the locking part 157*a* provided on the second rail part 157, and the protrusion part 135*c* protruding from a lower side of the rotator 135.

The hook part 135*b* is locked with the locking part 157*a* during a process of withdrawing the door guard 37. As the hook part 135*b* is locked with the locking part 157*a*, the other end of the elastic member 131, coupled to the connection member 133, is fixed and the one end of the elastic member 131 moves together with the door guard 37 in the direction in which the door guard 37 is being withdrawn, so that the elastic member 131 generates a tensile force.

In order for the elastic member 131 to generate a tensile force, the protrusion part 135*c* moves along the straight line path 125*a* of the guide rail 125, and if the withdrawing of the door guard 37 is completed, the rotator 135 rotates on the first rotating shaft 135*a* clockwise and the protrusion part 135*c* is locked with the locking groove 125*b*, so that the elastic member 131 maintains the tensile force.

The automatic closing unit 140 includes the first lever 141 rotatably coupled to the case 110 to make contact with the outer door 35, the second lever 143 rotatably coupled to the case 110 to make contact with the rotator 135, and a link 145 connecting the first lever 141 to the second lever 142.

The automatic closing unit 140 is coupled to a right portion of the case 110 adjacent to a portion of the inner door 31 at which the upper hinge 40 and the lower hinge 50 are provided, such that the automatic closing unit 140 makes contact with the outer door 35 when the outer door 35 is closed.

The first lever 141 of the door 30 having the upper hinge 40 and the lower hinge 50, which are configured to rotatably couple the door 30 to the body 10, is formed with the second rotation hole 141*a* rotatably coupled to the second rotating shaft 111 of the case 110, and the second lever 143 is formed with the third rotation hole 143*a* rotatably coupled to the third rotating shaft 113.

In a state in which the door guard 37 is being pulled out or withdrawn, the first lever 141 partially protrudes to the outside through the opening 114 formed through the case 110, and if the outer door 35 is closed while the door guard 37 is withdrawn, the first lever 141 protruding to the outside comes into contact with the outer door 35 before the door guard 37 comes into contact with the outer door 35.

Upon contact with the outer door 35, the first lever 141 rotates clockwise, and then is inserted into the case 110, and according to the rotation of the first lever 141, the second lever 143 connected to the first lever 141 through the link 145 rotates counterclockwise to operate the elastic unit 130, so that the door guard 37 is automatically inserted by the tensile force of the elastic member 131.

Hereinafter, a process of inserting and withdrawing the door guard 37 with the sliding device 100 will be described with reference to FIG. 5 and FIGS. 8 to 12.

Figure 8:
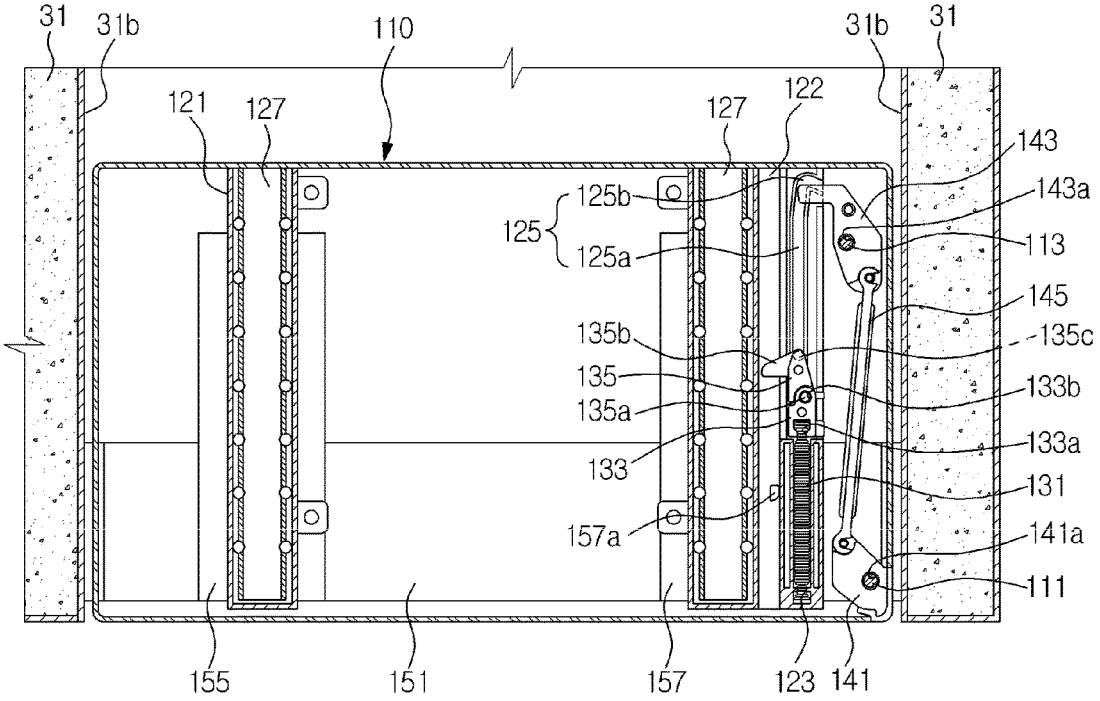
FIGS. 8 to 10 are drawings illustrating a process of a door guard being withdrawn in accordance with an embodiment of the present disclosure.

Referring to FIG. 8, in a state in which the door guard 37 is inserted, the first lever 141 of the automatic closing unit 140 is accommodated in the case 110.

Figure 9:
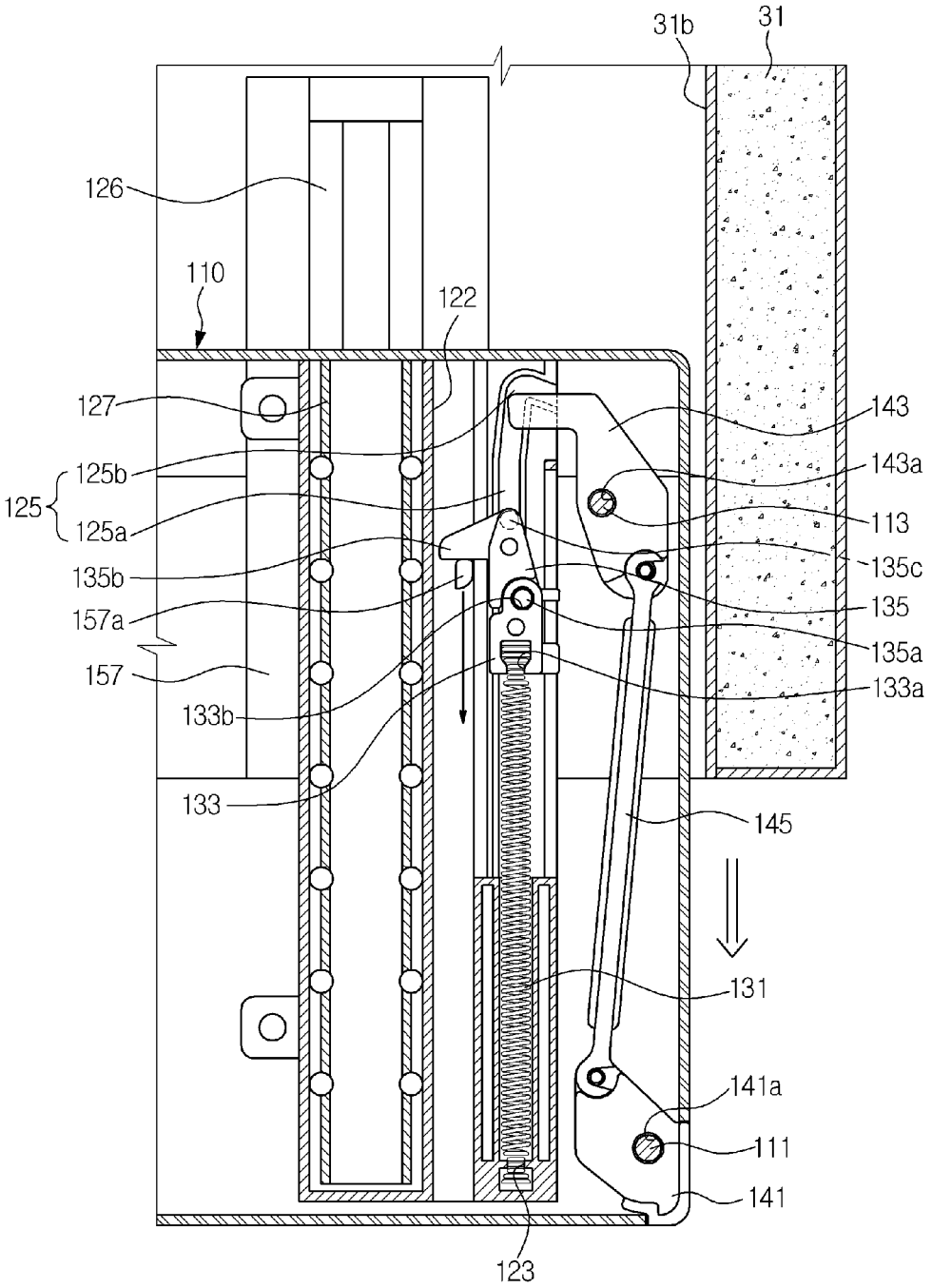

If the inserted door guard 37 is withdrawn as shown in FIG. 9, the case 110 coupled to the door guard 37 also moves together with the door guard 37 in a direction of the door guard 37 being withdrawn, and the second sliding part 122 of the sliding unit 120 coupled to the case 110 also moves in the direction of the door guard 37 being withdrawn.

If the second sliding part 122 moves in the direction of the door guard 37 being withdrawn, the elastic unit 130 fixed to the fixing part 123 of the second sliding part 122 moves together with the second sliding part 122 in the direction of the door guard 37 being withdrawn.

If the door guard 37 is partially withdrawn, the hook part 135*b* provided on the rotator 135 of the elastic unit 130 is locked with the locking part 157*a* provided on the second rail part 157.

As the hook part 135*b* is locked with the locking part 157*a*, the rotator 135, the connection member 133 connected to the rotator 135, and the other end of the elastic member 131 coupled to the connection member 133 are fixed, and the one end of the elastic member 131 coupled to the fixing part 123 of the second sliding part 122 moves together with the second sliding part 122 to generate a tensile force at the elastic member 131.

While the one end of the elastic member 131 is moving together with the second sliding part 122 in the direction of the door guard 37 being withdrawn, the protrusion part 135*c* of the rotator 135 is guided along the guide rail 125 provided on the second sliding part 122 so as to be moved in a direction opposite to the direction of the door guard 37, which is being withdrawn, with respect to the guide rail 125.

Figure 10:
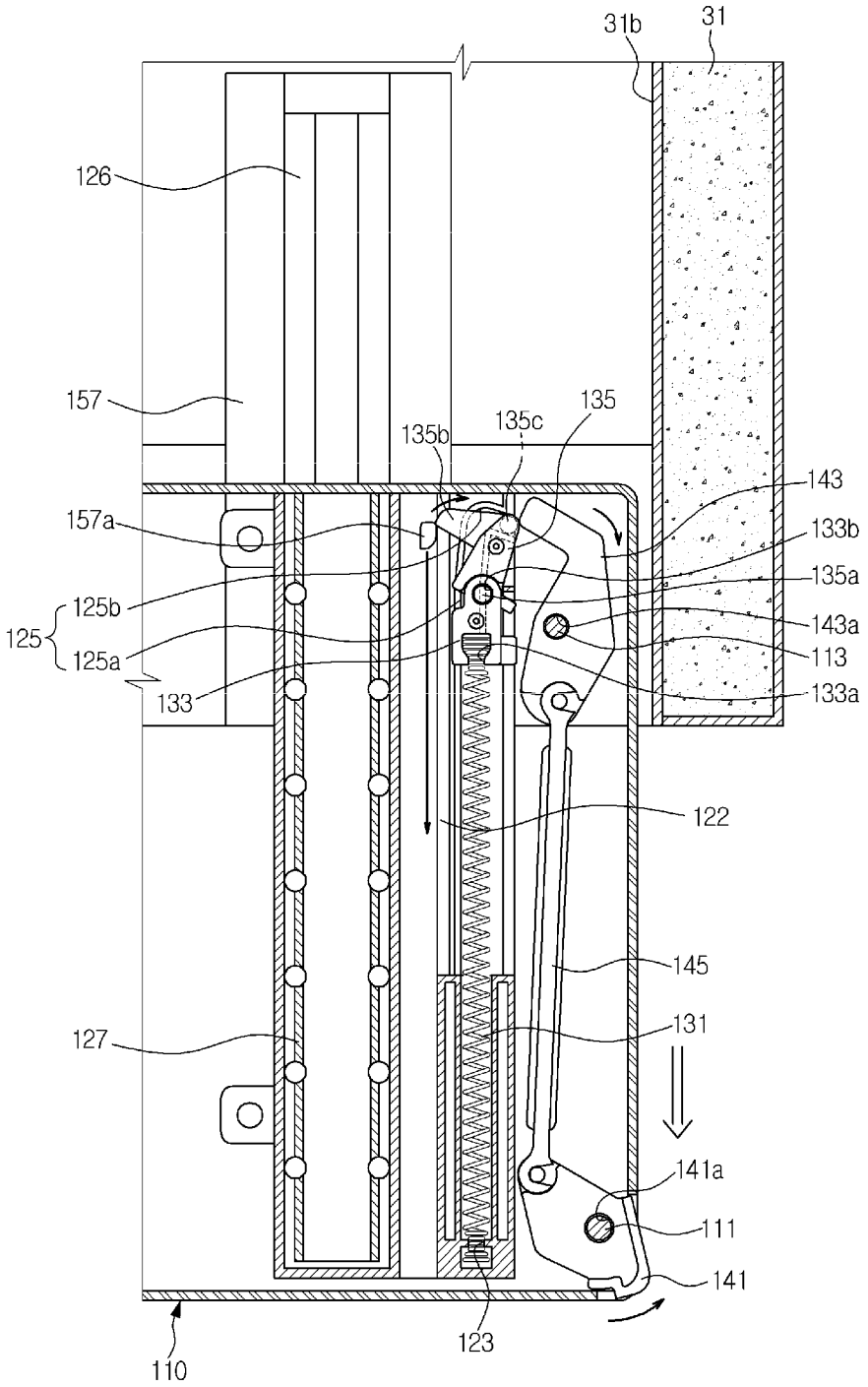

If the withdrawing of the door guard 37 is completed as shown in FIG. 10, the protrusion part 135*c*, while being guided along the straight line path 125*a* of the guide rail 125, is guided to the locking groove 125*b* provided at an end portion of the straight line path 125*a*.

Since the rotator 135 is coupled to the connection member 133 so as to rotate on the first rotating shaft 135*a*, when the rotator 135 rotates clockwise, the protrusion part 135*c* is guided to the locking groove 125*b*.

The protrusion part 135*c* guided to the locking groove 125*b* maintains a locked state with the locking groove 125*b* to maintain the tensile force of the elastic member 131, and the rotator 135, which rotates clockwise, making contact with the second lever 143 pushes the second lever 143 such that the second lever 143 rotates clockwise on the third rotating shaft 113.

If the second lever 143 rotates clockwise, the first lever 141 connected to the second lever 143 through the link 145 rotates counterclockwise on the second rotating shaft 111, so that a part of the first lever 141 protrudes through the opening 115 formed through the case 110.

Figure 5:
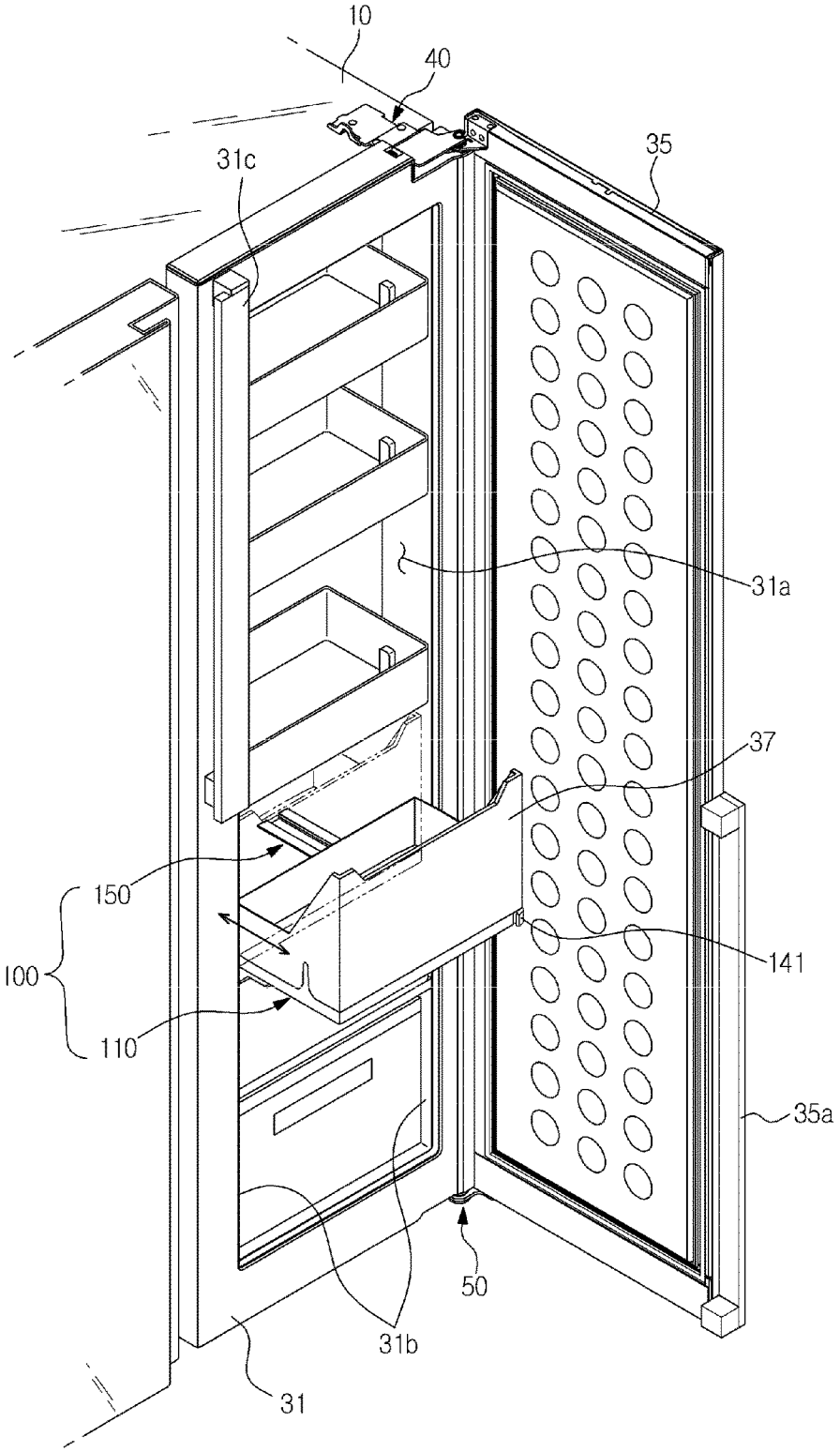
FIG. 5 is a perspective view illustrating a door guard being withdrawn in a state that an outer door of the refrigerator is open in accordance with an embodiment of the present disclosure.
Figure 6:
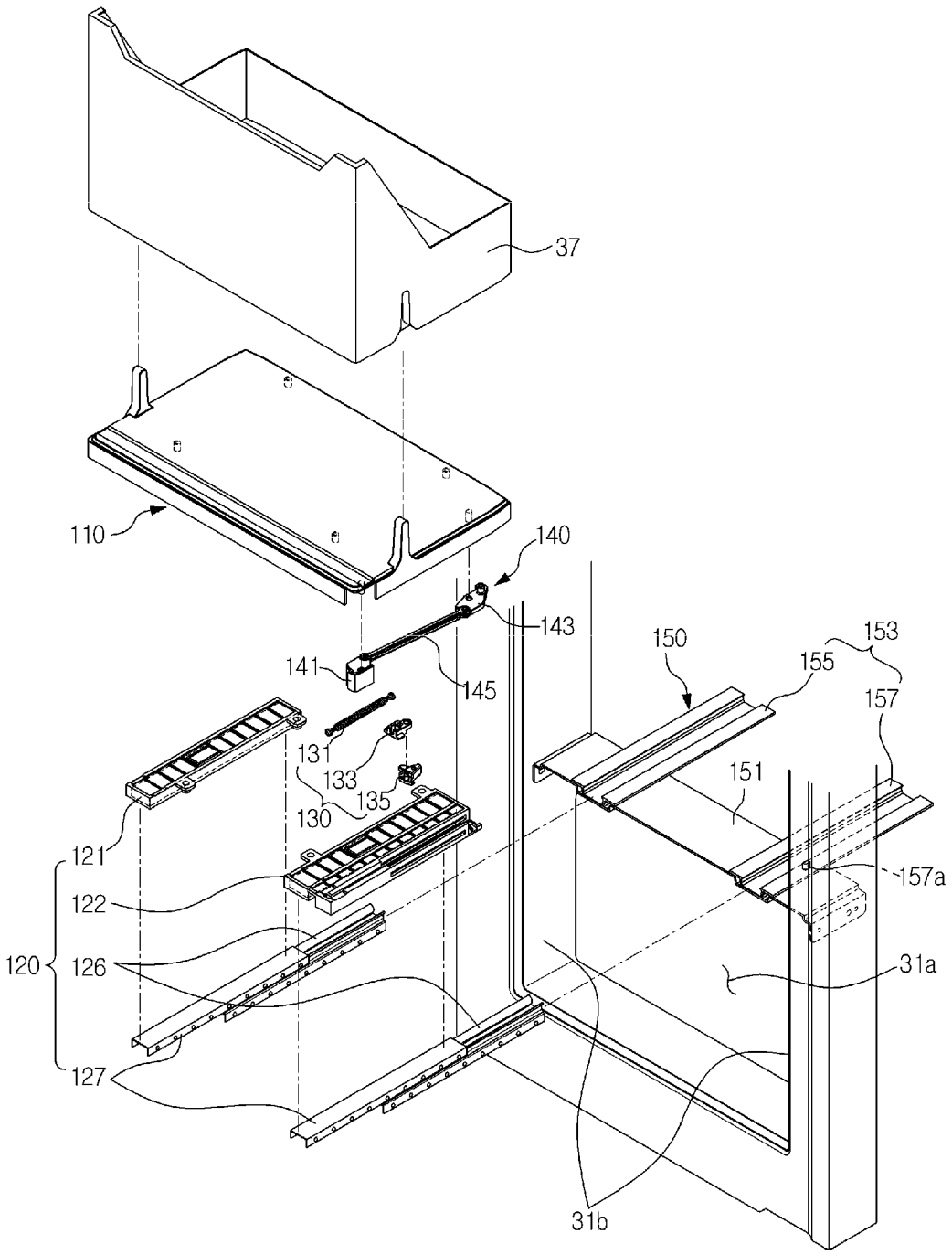
FIG. 6 is an exploded perspective view illustrating a door guard and a sliding device of the refrigerator in accordance with an embodiment of the present disclosure.
Figure 7:
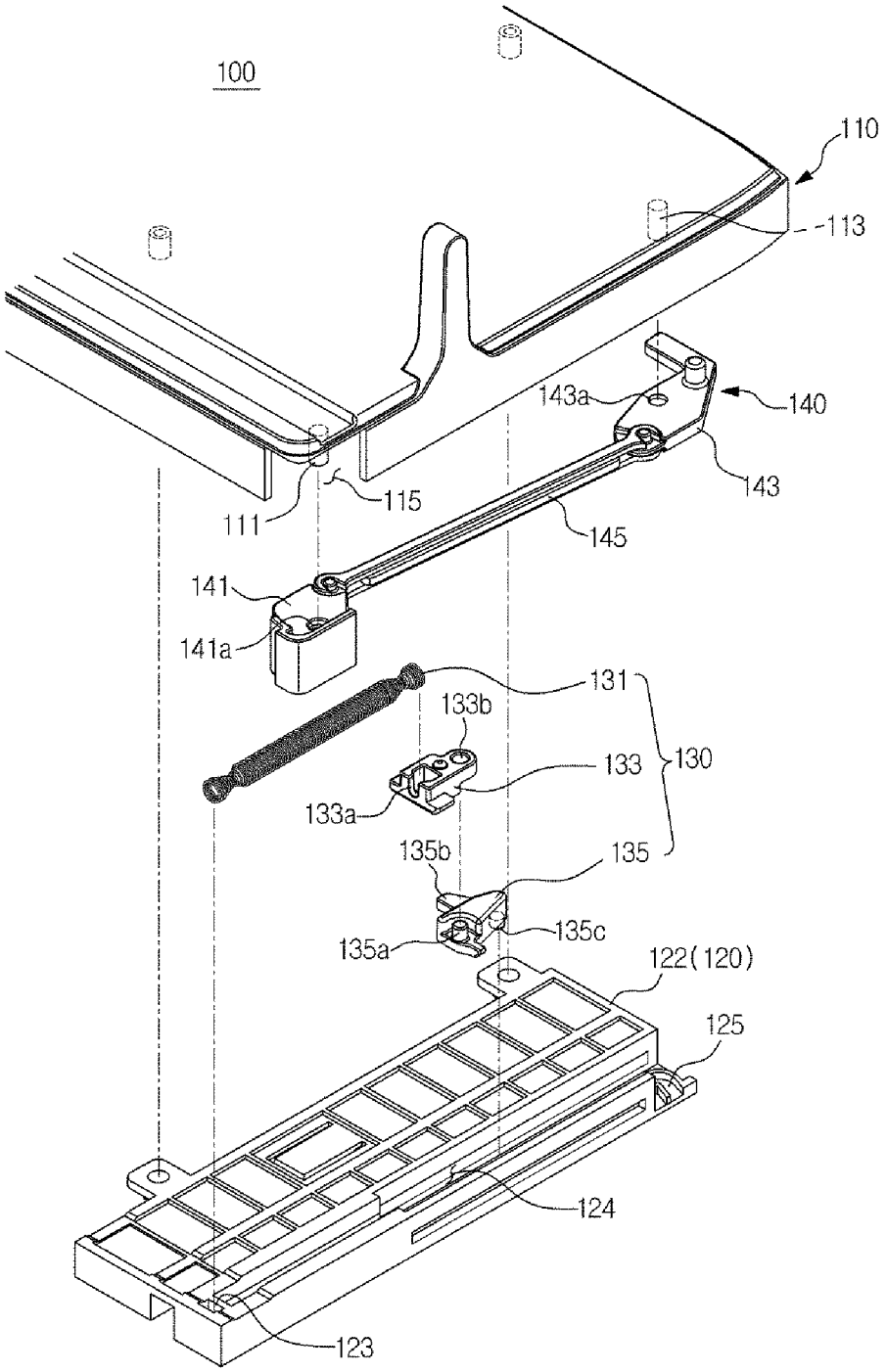
FIG. 7 is an exploded perspective view illustrating a sliding device of the refrigerator in accordance with an embodiment of the present disclosure.

When the withdrawing of the door guard 37 has been completed, as shown in FIGS. 5 and 10, a part of the first lever 141 of the automatic closing unit 140 protrudes to the outside through the opening 115 formed through the case 110.

Figure 11:
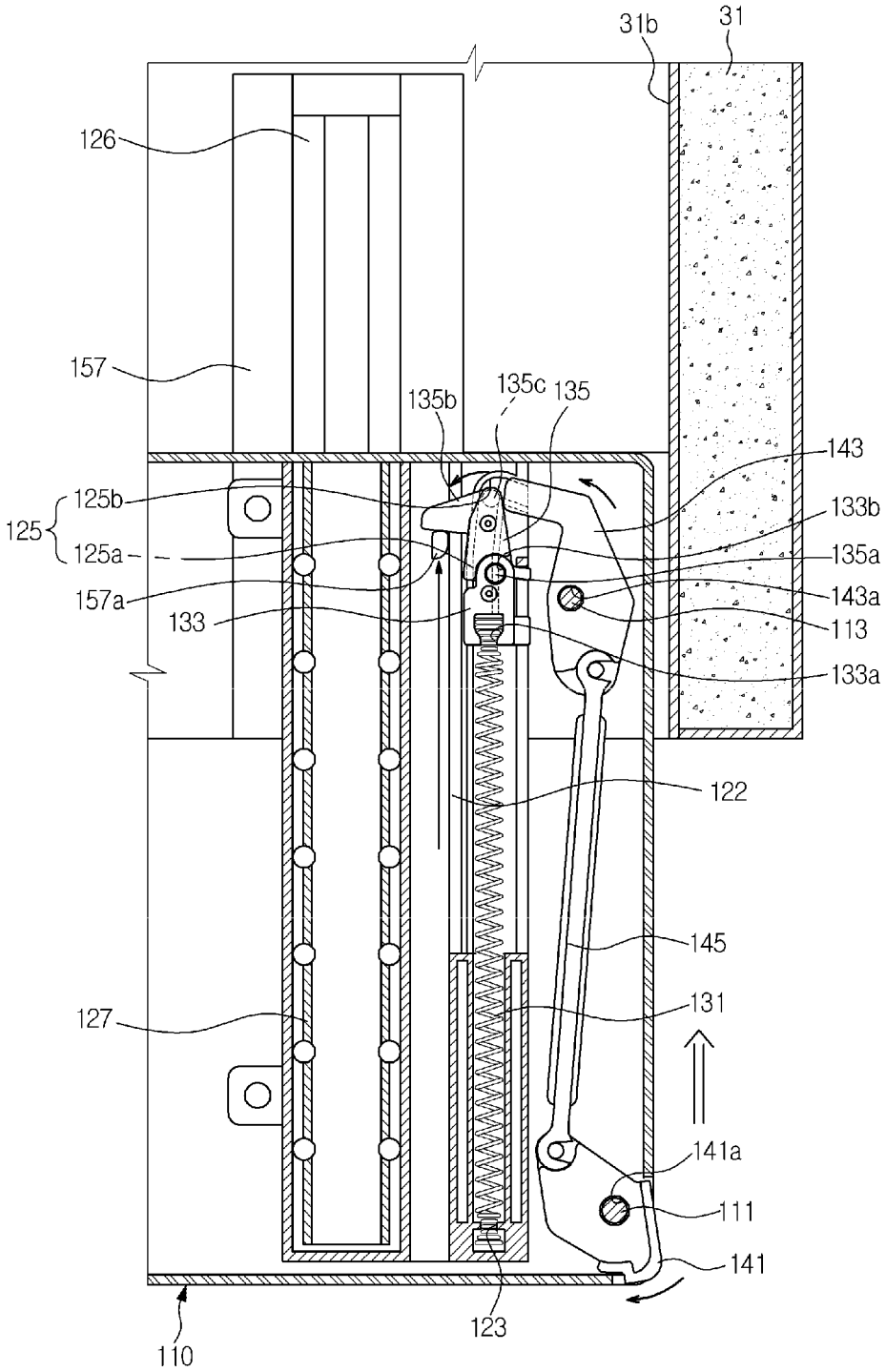
FIGS. 11 and 12 are drawings illustrating a process of a door guard automatically being inserted when an outer door is closed in a state that the door guard is withdrawn in accordance with an embodiment of the present disclosure.

When the outer door 35 is closed while the door guard 37 is withdrawn, as shown in FIG. 11, the first lever 141 making contact with the outer door 35 rotates on the second rotating shaft 111 clockwise, and the second lever 143 connected to the first lever 141 through the link 145 rotates counterclockwise on the third rotating shaft 113.

The second lever 143 rotating counterclockwise pushes the rotator 135, the protrusion part 135*c* of which is locked with the locking groove 125*b*, and thus the rotator 135 rotates counterclockwise on the first rotating shaft 135*a*.

As the rotator 135 rotates counterclockwise, the protrusion part 135*c* locked with the locking groove 125*b* escapes from the locking groove 125*b* and moves along the straight line path 125*a*.

Figure 12:
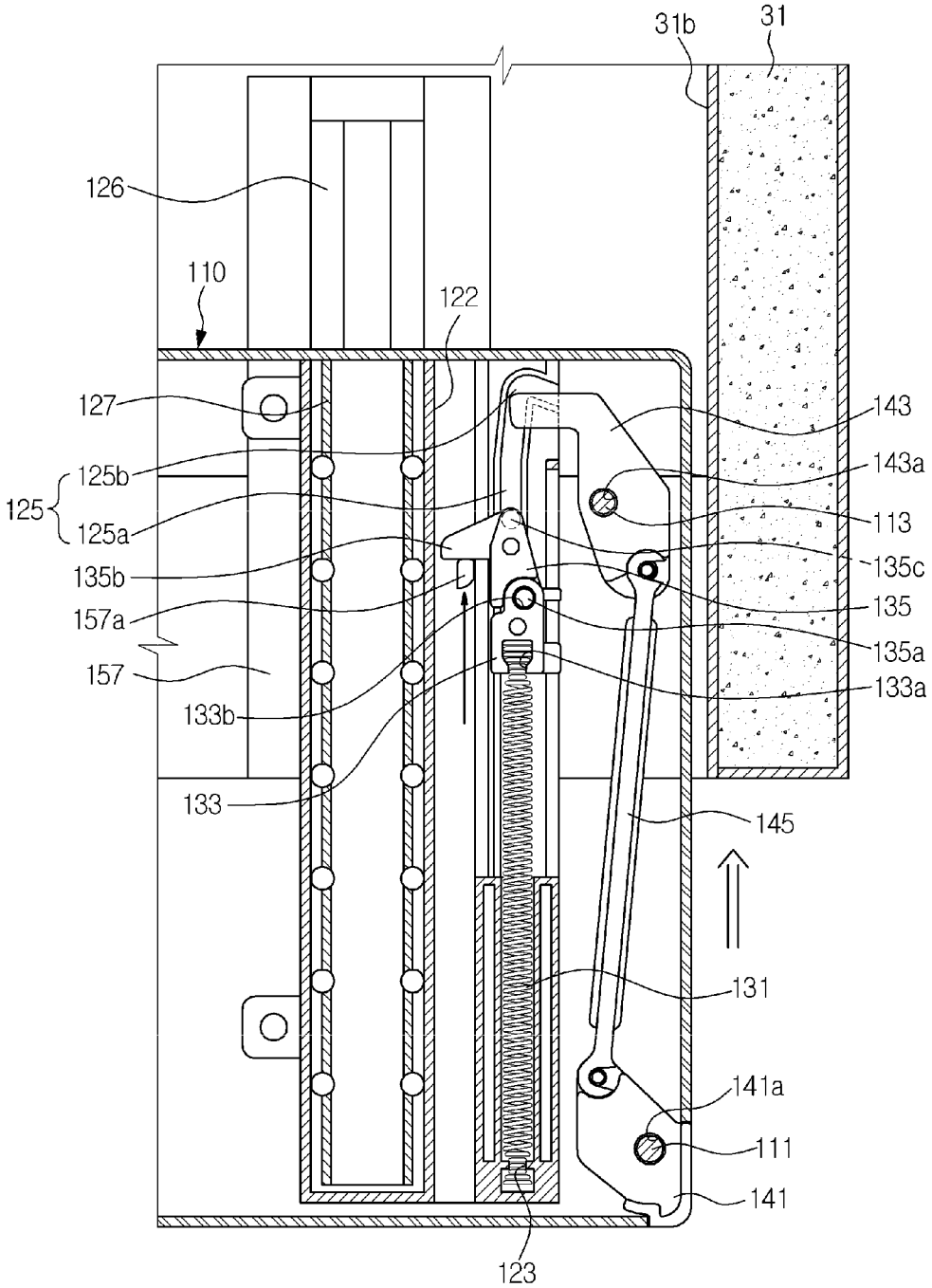

As the protrusion part 135*c* moves along the straight line path 125*a*, as shown in FIG. 12, the tensile force maintained by the elastic member 131 acts in a direction of the door guard 37 being inserted, and is transmitted to the door guard 37.

Since the door guard 37 having received the tensile force of the elastic member 131 is automatically inserted back into the refrigerating compartment 21 without having to be manually pushed, as described above, the shortcoming in which the outer door 35 fails to completely close when the outer door 35 is being closed while the door guard 37 is withdrawn is overcome, and the door guard 37 is prevented from breaking.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body;

a storage compartment at an inside of the body and open at a front surface thereof, and including a refrigerating compartment and a freezing compartment;

an inner door formed with an opening including a plurality of door guards, the inner door being configured to open or close the refrigerating compartment;

an outer door to open or close the opening of the inner door;

a case coupled to a lower portion of at least one of the plurality of door guards;

a guide rail allowing the at least one of the plurality of door guards to be inserted and withdrawn in a sliding manner and including a support part supported by both side walls of the opening of the inner door, and a plurality of rail parts extending from the support part to guide the at least one door guard and including a locking part protruding upward from at least one of the plurality of rail parts;

a slide unit including at least one sliding part coupled to a lower portion of the case and at least one slide rail coupled to an upper portion of the at least one slide rail, wherein the slide unit is capable of sliding along the guide rail such that the at least one door guard can be inserted or withdrawn;

an elastic unit including an elastic member having an end coupled to the slide unit to transmit a tensile force in a direction of the at least one door guard being inserted, a connection member coupled to an other end of the elastic member, and a rotator having one end of the rotator rotatably coupled to the connection member and a surface of an other end of the rotator releasably couplable to a side surface of the locking part; and an automatic closing unit including a first lever coupled to the case and a second lever linked to the first lever the automatic closing unit, configured to allow the elastic unit to transmit the tensile force to the at least one door guard when the outer door is closing, whereby the outer door when closing comes into contact with the first lever when the at least one door guard is withdrawn, such that the second lever contacts and rotates the rotator.

2. The refrigerator of claim 1, wherein the plurality of rail parts comprises a first rail part adjacent to a left side wall of the side walls, and a second rail part adjacent to a right side wall of the side walls.

3. The refrigerator of claim 2, wherein the case is coupled to a lower portion of the at least one door guard, and the slide unit is coupled to the case to move along the rail part such that the at least one door guard can be inserted or withdrawn.

4. The refrigerator of claim 3, wherein the at least one sliding part comprises a first sliding part coupled to a lower portion of the case to correspond to the first rail part, a second sliding part coupled to a lower portion of the case to correspond to the second rail part, first slide rails coupled to the first rail part and the second rail part, respectively, and second slide rails coupled to lower portions of the first sliding part and the second sliding part, respectively, so as to be slid along the first slide rails.

* * * * *